United States Patent [19]

Clark

[11] 4,190,154

[45] Feb. 26, 1980

[54] STERILE PACKAGE

[75] Inventor: James A. Clark, Honeoye Falls, N.Y.

[73] Assignee: Bausch & Lomb Incorporated, Rochester, N.Y.

[21] Appl. No.: 875,063

[22] Filed: Feb. 6, 1978

[51] Int. Cl.[2] ..... A61B 19/02

[52] U.S. Cl. ..... 206/438; 206/439; 206/363

[58] Field of Search ..... 206/438, 439, 363, 364, 206/365

[56] References Cited

U.S. PATENT DOCUMENTS

| | | | |
|---|---|---|---|
| 3,057,471 | 10/1962 | Stonehill | 206/438 |
| 3,315,802 | 4/1967 | Lonholdt | 206/363 |
| 3,361,253 | 1/1968 | Lonholdt | 206/363 |
| 3,768,725 | 10/1973 | Pilaro | 206/439 |
| 3,926,311 | 12/1975 | Laske | 206/439 |
| 3,939,971 | 2/1976 | Tulis | 206/363 |
| 3,942,634 | 3/1976 | Gandi | 206/438 |

FOREIGN PATENT DOCUMENTS

| | | | |
|---|---|---|---|
| 988693 | 4/1965 | United Kingdom | 206/438 |
| 1395257 | 5/1975 | United Kingdom | 206/438 |

*Primary Examiner*—Herbert F. Ross
*Attorney, Agent, or Firm*—Frank C. Parker

[57] ABSTRACT

An improved sterilizable, sterility maintaining, peelable package for sterile products constructed of an envelope, a peeling film inserted in and extending from one end of the envelope and a closure around the exterior of the package which hermetically seals the package, and seals the peeling film to the envelope. The peeling film is constructed of a sheet of sterilizable plastic film having a density appreciably dissimilar from the density of the envelope.

16 Claims, 3 Drawing Figures

STERILE PACKAGE

BACKGROUND OF THE INVENTION

This invention relates, generally, to flexible packaging devices, and more specifically to sterilizable, sterility maintaining, peelable packages for sterile products.

One of the major advances in modern health care technology has been the mass production of presterilized medical instruments and supplies, packaged in disposable, sterility maintaining flexible pouches and envelopes. The use of such disposable packaging eliminates the need for resterilization of the medical devices contained therein by hospitals, doctors, or medical personnel when use of the sterile product is desired. Consequently, the use of such packages has been widespread. One of the problems associated with such packages, however, is how to open them without having the sterile product contact a torn edge, a portion of which would be on the outside of the package and therefore contaminated.

Previous attempts to overcome these difficulties, such as those shown in the patents of Spees, U.S. Pat. No. 3,053,385; Lonholdt et al, U.S. Pat. No. 3,315,802; Armentrout, U.S. Pat. No. 3,547,257; Rohde, U.S. Pat. No. 3,186,628; Hermanson et al, U.S. Pat. No. 3,123,210; Lasky, U.S. Pat. No. 3,926,311; Link, U.S. Pat. No. 3,724,651; Powell, U.S. Pat. No. 3,332,549 and Kurtz, U.S. Pat. No. 3,256,981, have met with varying success. However, many of the peelable packages disclosed in the listed prior patents require expensive laminations or coatings on one or more layers of the package. Additionally, experience has shown that the peelability of such packages is irregular due to variations in coating density, film thickness, sealing temperatures and sealing pressure.

Accordingly, it is an object of the present invention to provide sterile packages which effectively seal the sterile products contained within against contamination;

It is an additional object of the invention to provide a sterile package with reliabile peelability characteristics; and It is an object of the invention to provide such packages in a form which is easy and inexpensive to manufacture.

SUMMARY OF THE INVENTION

The present invention is an improved sterilizable, sterility maintaining, peelable package for sterile products.

The invention comprises an envelope for packaging sterile products, a peeling film inserted in and extending from one end of the envelope for opening the package, and closure means for sealing the top and bottom of the package and for sealing the peeling film to the envelope. The peeling film is comprised of a sheet of sterilizable plastic film, having a density appreciably dissimilar from the density of the envelope material. In a preferred embodiment, the envelope comprises a tube of sterilizable plastic or paper. The peeling film is constructed of a plastic material which may be peeled from the envelope without depositing particles or residue on the sterile product and without leaving a feathered edge on either the peeling film or the envelope.

The peeling film has a cut-out portion at a first end which circumscribes the top of the sterile product. The sides of the cut-out portion are located so that the cut-out portion positions the sterile product away from the seals of the package when the package is opened. Since the seals have a portion facing the exterior of the package, that portion is contaminated. Therefore, positioning the product away from the seals helps prevent contamination of the product when the package is opened or the product removed.

In a preferred embodiment, the invention includes slits integrally formed lengthwise along opposite sides of the envelope making it easier to peel down the front portion of the package. The scores are positioned outside of the cut-out portion of the peeling film so that the peeling film is interposed between the slits and the product when the package is opened, thereby preventing contamination.

In a preferred embodiment of the invention, the sterile package has side positioning seals extending from the edge of the package towards the center which position and restrain the sterile product within the package. More importantly, the side positioning seals limit the opening of the package to the proximity of the cut-out portion of the peeling film, again preventing contamination of the sterile product when opening the package.

The closure system of the package comprises a grid of fused heat seals which hermetically seal the envelope thereby preventing contamination of the product. The top seal portion is curved in order to enhance the peelability of the package. The curvature reduces the area to which shearing forces are applied, thereby rupturing the seal before either film member. A hermetically sealed inner pouch is enclosed about the sterile product. The pouch is the same size as the gap between the side positioning seals in order to help hold the pouch in place, thereby securing the product. The pouch also provides a secondary sterile barrier in the event that the closure system is compromised.

A tack seal at the top of the package joins the peeling film to one side of the envelope so that the peeling film and that side of the envelope remain together during peeling, thereby facilitating the tearing down of the opposite side of the tube away from the peeling film. In a preferred embodiment, the envelope is comprised of low density polyethylene. The peeling film is comprised of high density polyethylene. An example of such a material is DuPont "TYVEK" (TM) spun bonded polyolefin.

In one embodiment the envelope is constructed of a top sheet of sterilizable plastic material, and a bottom sheet of sterilizable plastic material, hermetically sealed by the closure system along the top, bottom and sides of the package.

DETAILED DESCRIPTION OF THE PREFERRED EMBODIMENT

Figure 2:
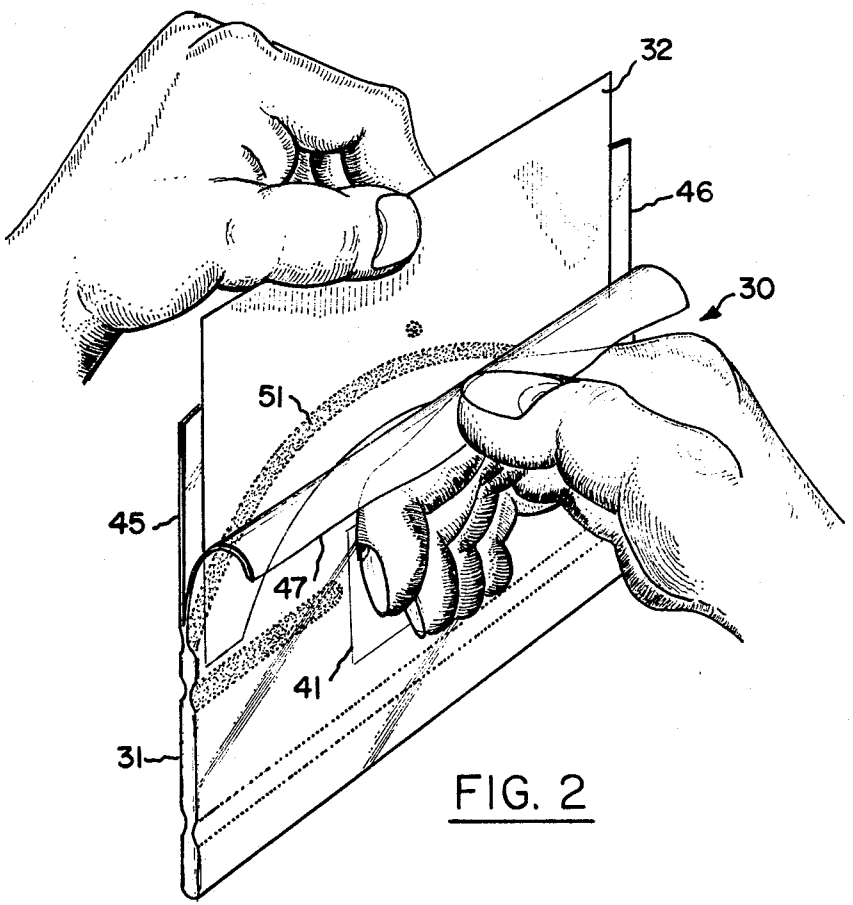
FIG. 2 of the drawings is a front perspective view of the embodiment of the invention shown in FIG. 1 and showing the sterile package being peeled open.

While this invention is susceptible of embodiment in many different forms, there is shown in the drawings specific embodiments which are to be considered as an exemplification of the principles of the invention and not intended to limit the invention to the embodiments illustrated. Improved sterilizable peelable package 30, shown in FIG. 1, comprises envelope means 31 which is constructed of sterilizable plastic material or sterilizable paper. A peeling film 32 is inserted in and extends from one end 33 of envelope means 31. Peeling film 32 is constructed of a material having a higher density than that of envelope means 31 which improves the peelability of the package. Closure system 34 hermetically seals envelope means 31 proximate to the top 35 and bottom 36 of package 30 and also seals peeling film 32 to envelope 31. Peeling film 32 is sealed by closure means 34 across portions 37 and 38 of sides 39 and 40 of package 30. Due to peeling film 32, closure means 34 may be peeled open and sterile product 41 removed without contamination. In a preferred embodiment envelope means 31 is constructed from a tube of sterilizable film.

In a preferred embodiment the peeling film 32 is constructed of a plastic, such as high density polyethylene which may be peeled from envelope means 31 without depositing particles or residue from either film on sterile product 41. In addition, feeling film 32, when peeled, does not leave a feathered edge (shreds of film) on either the peeling film 32 or envelope means 31.

Peeling film 32 has a cut-out portion 42 at first end 43 of peeling film 32 which circumscribes portion 44 of sterile product 41. Cut-out 42 positions sterile product 41 away from sides 39 and 40, and away from closure means 34 when package 30 is opened, thereby preventing contamination, since portions of sides 39 and 40 as well as the exterior portion of closure means 34 are not within package 30 and are therefore recontaminated by the atmosphere after sterilization.

The invention further comprises slits 45 and 46 along portions of sides 39 and 40 of envelope means 31 which allow front portion 47 of envelope 31 to be peeled from rear portion 48. Slits 45 and 46 are positioned away from cut-out portion 42 of peeling film 32 so that peeling film 32 is interposed between the sterile product 41 and slits 45 and 46 thereby preventing contamination when the package is opened.

Side positioning seals 49 and 50 limit the amount that package 30 can be opened to the area proximate first end 43 of peeling film 32. This prevents sterile product 41 from contacting a contaminated portion of the package.

Closure means 34 comprise a linear grid of fused heat seals proximate the top 35 and bottom 36 of package 30, which prevent contamination of sterile product 42 within the package. Top seal 51 which is a portion of closure means 34 is curved in order to enhance the peelability of closure means 34. Curving of the top seal provides a minimum area of seal to rupture initially. Once the seal begins to peel, resistance to further peeling is reduced.

Figure 1:
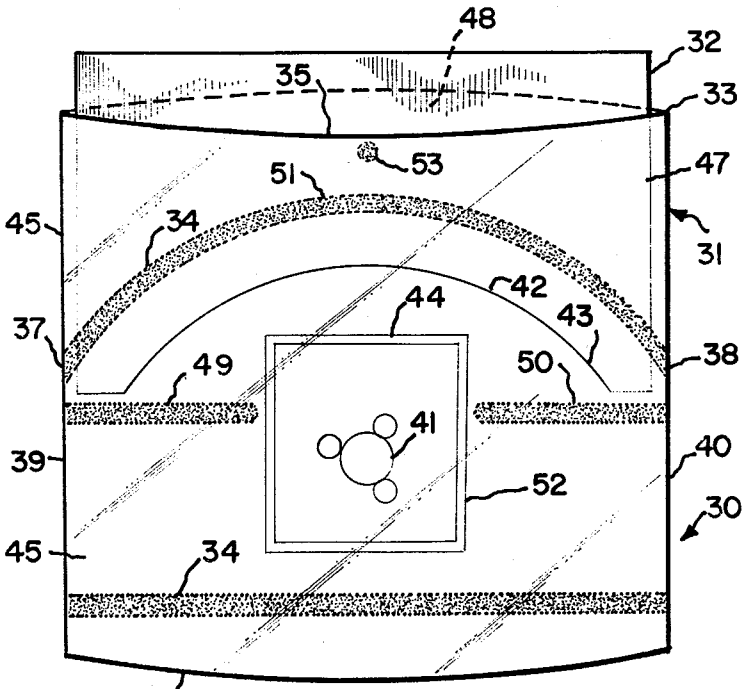
FIG. 1 of the drawings is a front view of one embodiment of the invention.

As further shown in FIG. 1 of the drawings, the invention includes a hermetically sealed inner pouch 52 enclosed about sterile product 41 within peelable package 30 which is sized to precisely fit between side positioning seals 49 and 50, so that pouch 52 can later be removed from package 30 without touching closure means 34 or slits 45 and 46. In addition, pouch 52 provides a secondary sterile barrier in the event that the primary package 30 is compromised, i.e. that the seals fail or the package is punctured.

The invention further includes a tack seal 53 proximate to first end 33 of envelope means 31 for attaching peeling film 32 to a rear portion 48 of envelope means 31. Thus, peeling film 32 and rear portion 48 of envelope means 31 remain together when front portion 47 of envelope means 31 is peeled from package 30. The combined stiffness of the two films makes peeling front portion 47 easier.

FIG. 2 of the drawings shows peeling film 32 of package 30 being held in one hand and front portion 47 of envelope means 31 being peeled open. Top seal 51 of closure means 34 has already been peeled open. The result is that sterile product 41 is exposed for removal from package 30 without contacting a contaminated surface.

Figure 3:
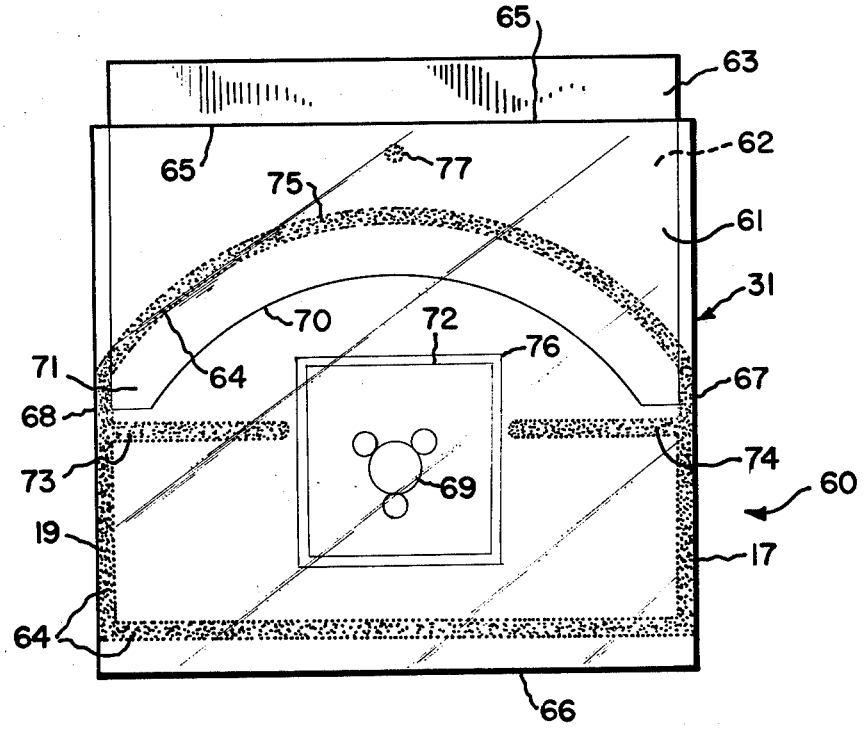
FIG. 3 of the drawings is an alternative embodiment of the invention showing in particular envelope means constructed from top and bottom film members.

In an alternative embodiment of the invention, improved sterilized package 60, shown in FIG. 3, envelope means 31 comprises a top film member 61 and a bottom film member 62. Peeling film 63 is interposed between top film member 61 and bottom film member 62. Closure means 64 hermetically seals the top portion 65, bottom portion 66 and sides 67 and 68 of sterile package 60.

As in the previous embodiment, peeling film 63 may be peeled from top film member 61 or bottom film member 62 without depositing particles or residue on sterile product 69. In addition, peeling of peeling film 63 does not leave a feathered edge either on peeling film 63 or on top film member 61 or bottom film member 62.

Peeling film 63 has a cut-out portion 70 at first end 71 of peeling film 63 which circumscribes portion 72 of sterile product 69. Cut-out 70 acts as a shield to prevent sterile product 69 from contacting closure 64. Contamination of sterile product 69 is thereby prevented when product 69 is removed from package 60. Additionally, side positioning seals 73 and 74 limit the amount the package can be opened to the area proximate cut-out 70, further insuring that sterile product 69 will not contact a contaminated surface. Side positioning seals 73 and 74 also restrain sterile product 69 within package 60.

As further shown in FIG. 3, closure system 64 comprises a linear grid of heat seals which fuse top film member 61 and bottom film 62 to each other and to peeling film 63. Closure system 64 hermetically seals package 60 against contamination. Additionally, top seal 75 of closure system 64 is curved. This curvature reduces the area of the seal being stressed and results in a shearing of the seal rather than one of the film members.

Package 60 also includes a hermetically sealed inner pouch 76 enclosed about sterile product 69 which is held between side positioning seals 73 and 74 in order to further secure product 69. Pouch 76 also provides a secondary sterile barrier in the event that primary package 60 is compromised.

Additionally shown in FIG. 3 of the drawings is a tack seal 77 near the top 65 of package 60 for attaching the peeling film 63 to the bottom film 62 so that peeling film 63 remains attached to bottom film 62 when top film 61 is peeled. This double layer of film increases the stiffness of the surface from which top film 61 is peeled, thereby making it easier to peel.

The foregoing description and drawings merely explain and illustrate the invention and modifications and variations may be made therein without departing from the scope of the invention.

What is claimed is:

1. An improved sterilizable, sterility maintaining, peelable package for sterile products which comprises:

envelope means;

peeling film means inserted in and extending from one end of said envelope means for opening a portion of said package and removal of said sterile product without contamination;

said peeling film means extending for only a portion of the length of said envelope means in order to facilitate the opening of said envelope means while at the same time minimizing the quantity of material required;

said peeling film means comprising an untreated sheet of sterilizable plastic film having a density appreciably dissimilar from the density of said envelope means; and closure means for hermetically sealing said envelope means and for hermetically sealing said peeling film means to said envelope means.

2. The invention according to claim 1 in which said envelope means comprises a seamless tubular film member.

3. The invention according to claim 1 in which said closure means comprises:

a linear grid of fused heat seals which hermetically seal said envelope means thereby preventing the contamination of said sterile product; and a top seal portion of said closure means being curved in order to facilitate initiation of the peeling of said seal.

4. The invention according to claim 1 in which said peeling film means has a cut-out portion which circumscribes a portion of said sterile product and positions said sterile product away from said closure means thereby preventing the contamination of said sterile product upon the peeling open of said package.

5. The invention according to claim 4 further comprising:

side positioning seal means for limiting the opening of said package to the area proximate said cut-out portion of said peeling film thereby allowing said sterile package to be held in an open position while retaining said sterile product.

6. The invention according to claim 5 further comprising:

hermetically sealed inner pouch means enclosed about said sterile product which cooperate with said side positioning seal means to position said sterile product away from said closure means and which provide a secondary sterile barrier in the event that the primary package is compromised.

7. The invention according to claim 1 in which the invention further comprises:

tack seal means proximate to a first end of said peeling film means for attaching said peeling film to a first side of said envelope means thereby facilitating the peeling of a second side of said envelope means from the combination of said peeling film means and said first side of said envelope means.

8. The invention according to claim 7 further comprising:

slit means integrally formed lengthwise along a portion of the sides of said envelope means for freeing said second side of said envelope from said first side so that said second side may be peeled from the combination of said peeling film means and said first side of said envelope means.

9. The invention according to claim 1 in which said envelope means comprises low density polyethylene.

10. The invention according to claim 1 in which said peeling film means comprises high density polyethylene.

11. The invention according to claim 1 in which said envelope means comprises:

a top film member; and a bottom film member, said closure means hermetically sealing said top film member to said bottom film member proximate to the top, bottom and sides of said package, with said peeling film member juxtaposed therebetween and extending therefrom.

12. The invention according to claim 11 in which said top film member comprises low density polyethylene film.

13. The invention according to claim 10 in which said bottom film member comprises low density polyethylene film.

14. The invention according to claim 2 in which said tubular film and said peeling film consists of a material which does not deposit residue or debris when torn thereby preventing deposit of such particles or residue into said package when opened.

15. The invention according to claim 1 in which said envelope means and said peeling film means consist of a material which does not deposit residue or debris when torn, thereby preventing deposit of such particles or residue into said package when opened.

16. The invention according to claim 1 in which said envelope means and said peeling film means are constructed of a material which does not leave a feathered edge when peeled, thereby preventing contamination of said sterile product during removal from said package.

* * * * *